United States Patent [19]

Cobaugh et al.

[11] 4,220,390

[45] Sep. 2, 1980

[54] TERMINATING MEANS FOR TERMINATING MORE THAN ONE WIRE IN A SINGLE SLOTTED TERMINAL

[75] Inventors: Robert F. Cobaugh, Elizabethtown; Norwood C. Graeff, Harrisburg, both of Pa.

[73] Assignee: AMP Incorporated, Harrisburg, Pa.

[21] Appl. No.: 927,719

[22] Filed: Jul. 25, 1978

Related U.S. Application Data

[63] Continuation-in-part of Ser. No. 831,445, Sep. 8, 1977, abandoned, which is a continuation-in-part of Ser. No. 744,003, Nov. 22, 1976, abandoned.

[51] Int. Cl.[3] ..... H01R 13/38

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 3,380,013 | 4/1968 | Krone et al. | 339/97 P |
| 3,617,983 | 11/1971 | Patton | 339/98 |
| 3,932,017 | 1/1976 | Dechelette | 339/97 P |
| 3,950,062 | 4/1976 | Reavis, Jr. | 339/97 R |
| 3,972,578 | 8/1976 | Reynolds et al. | 339/15 |

FOREIGN PATENT DOCUMENTS

| | | | |
|---|---|---|---|
| 1259992 | 2/1968 | Fed. Rep. of Germany | 339/97 R |

OTHER PUBLICATIONS 1640630 10001969 DEX 339 97 R

*Primary Examiner*—Joseph H. McGlynn
*Attorney, Agent, or Firm*—Gerald K. Kita

[57] ABSTRACT

A terminal is disclosed of the type in which a conductor is terminated by moving the conductor transversely of its axis into a slotted opening having a width less than the diameter of the wire. The terminal comprises two metal plates which pivot transversely of each other and which have individual slotted openings defined by slicing edges. The slotted openings overlie each other to provide a common wire-receiving opening so that a wire in either an upper section or a lower section of the common opening will tend to narrow the width of the corresponding other section.

9 Claims, 35 Drawing Figures

FIG. 10
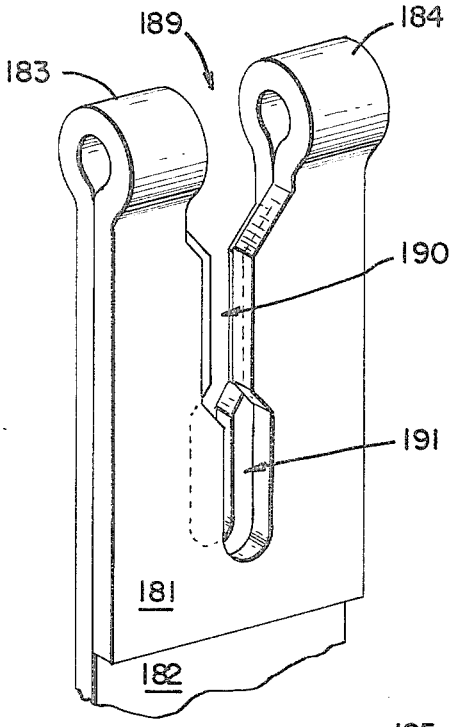
FIG. 13
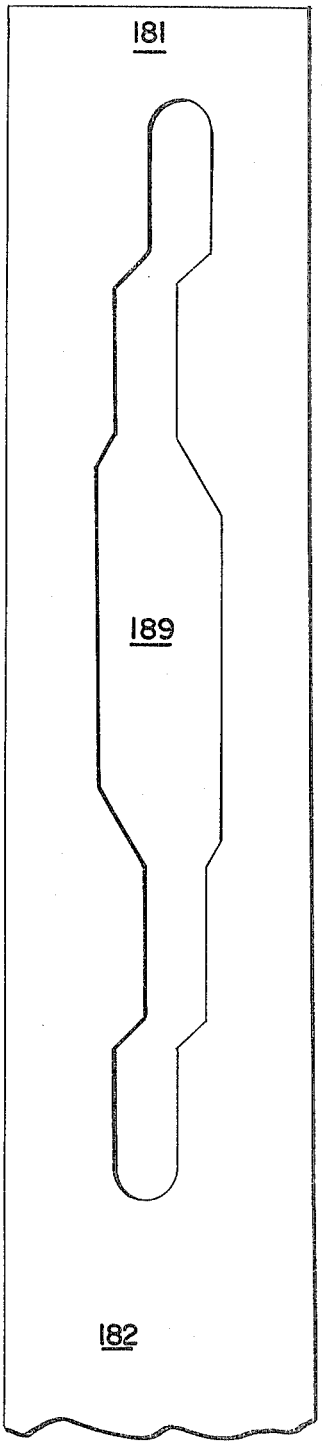
FIG. 11
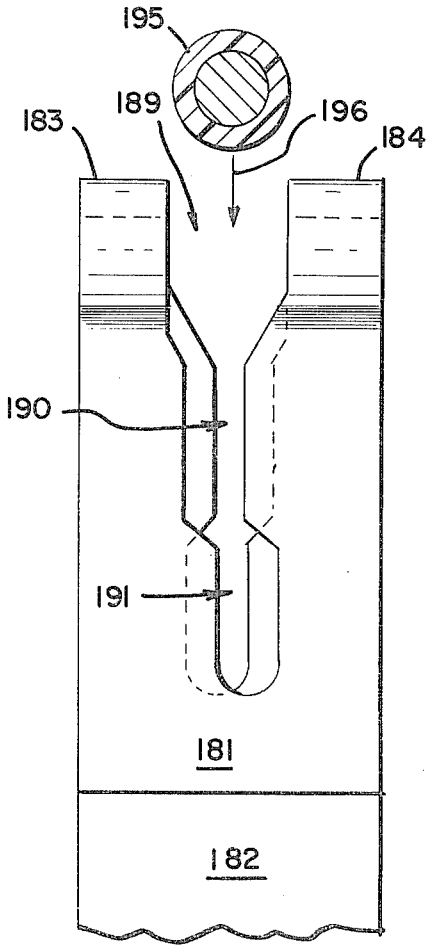
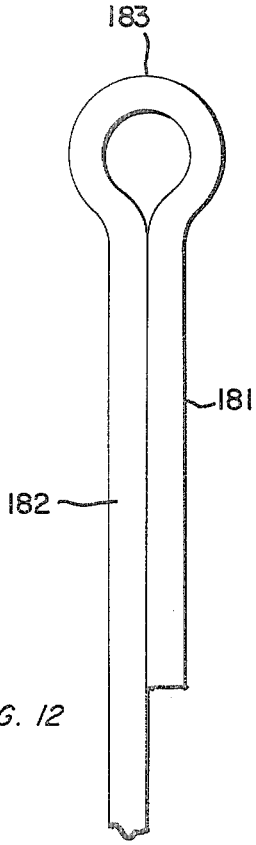
FIG. 12

TERMINATING MEANS FOR TERMINATING MORE THAN ONE WIRE IN A SINGLE SLOTTED TERMINAL

CROSS REFERENCE TO RELATED APPLICATIONS

The present application is a continuation-in-part of application Ser. No. 831,445, filed Sept. 8, 1977, now abandoned, which in turn is a continuation-in-part of application Ser. No. 744,003, filed Nov. 22, 1976, now abandoned, by Robert Franklin Cobaugh and Norwood Claude Graeff entitled "Terminating Means For Terminating More Than One Wire In A Single Slotted Terminal".

BACKGROUND OF THE INVENTION

This invention relates generally to means for terminating wires without solder and more particularly it relates to means for terminating two or more wires in a single slotted terminal without the use of solder.

There are many known ways of terminating two or more wires on a single terminal, including for example, terminal bars constructed to receive two or more wires terminated in ring tongue or spade-like terminals, terminals having two or more wire barrels therein and terminals having positions where two or more wires can be soldered thereto. Another more recent means of terminating two or more wires is by inserting two wires into a single slot in a plate-like terminal wherein the width of the slot is less than the diameter of the wire so that the edges of the slot cut through the insulation and into the metal conductor of the wire to form the electrical and mechanical connections. One of the difficulties encountered with such an arrangement is that while the single slot functions to retain the first wire quite effectively, when a second wire is inserted into the slot, there is a likelihood that one of the wires will be slightly larger than the other so that the mechanical and electrical connection on the other of the wires is necessarily decreased, perhaps to the point where electrical connection is faulty and sometimes even to the point where the other wire, if it is the upper wire, can fall out of the slot.

In order to minimize the foregoing problem, single slotted terminals have been developed with apertures formed on one or both sides of the slot which results in the formation of two beams defining the sides of the slot. Thus, when the wires are inserted into the slots the beams deflect outwardly and maintain a spring-like force upon the wires. It has been found, however, that such arrangements do not completely solve the problem and that insertion of two wires into the slots frequently results in deterioration of electrical and/or mechanical connection of one or both wires. The insertion of two wires into the slot will result in a lessened force exerted upon either of the wires than would be the case if only one wire were inserted into the slot.

BRIEF STATEMENT OF THE INVENTION

It is a primary object of the invention to provide improved single slotted terminals capable of terminating at least two wires without the use of solder.

A second aim of the invention is to provide single slotted terminals for effecting the solderless terminating of at least two wires with the presence of each wire enhancing the retention forces exerted against the other wire as compared with the retention forces that would be applied against a single wire only being inserted in the slot.

A third purpose of the invention is a single slotted terminal capable of a solderless termination of two or more wires, which terminal exerts a continuing spring-like retention force against a single wire inserted therein and when two wires are inserted therein functions to provide at least an equal or increased retention force against each of said two wires due to the presence of the second wire.

A fourth purpose of the invention is an improved solderless terminal for terminating at least two wires in a single slot in said terminal and in which the retention force on each of said two wires is spring-like in nature and is enhanced by the presence of the other wire.

A fifth aim of the invention is an inexpensive, efficient, single slotted terminal for receiving and retaining at least two wires therein with higher and longer lasting retention forces than heretofore obtainable.

A sixth purpose of the invention is the improvement of slotted terminals generally for the retention of more than one wire.

In one form of the invention the terminal comprises a strip of sheet metal which is bent over upon itself to form a first and a second plate-like elements joined together at first ends thereof. Each of the first and second plate-like elements has a two stage slot formed therein with the first stages of the slots of the two plate-like elements extending from the second end of the two plate-like elements and downwardly towards the first ends thereof, and further being offset with each other to leave a resulting first stage slot, one side of which is formed by the edge of the slot in the first plate-like element and the other side of which is formed by the edge in the second plate-like element, with said resulting first stage slot having a width less than the diameter of the conductive portion of the wire which is to be inserted therein. The second stages of the slots in the first and second plate-like elements, are each offset with respect to the first stage in the same plate-like element but in opposite directions and to a degree so as to form a resulting second stage slot, one side of which is defined by the edge of the second stage of the slot in the second plate-like element and the other side of which is formed by the edge of the second stage of the slot formed in the first plate-like element. The first and second stages of the slots in each plate-like element are joined together by a short, connecting stage formed at an angle in the plate-like element so as to join the lower end of the first stage of the slot and the upper end of the second stage of the slot. Such two connecting slot sections cross each other since the second stages of the two slots are offset in opposite directions from the first stages thereof. Thus, the overall resulting slot formed by the two plates is a long slot of substantially constant width but with the first side of the resulting upper of first stage being formed by the first plate and the second side of the resulting upper stage formed by the second plate, and the first side of the resulting lower stage being formed by the second plate and the second side of the resulting lower stage being formed by the first plate.

Thus, a wire inserted into the resulting second stage of the resultant slot will tend to deflect, in opposite transverse directions, the first and second plates, which in turn will tend to narrow the width of the resulting upper stage of the resulting slot. Subsequently, when a wire is inserted in the resulting upper stage of the resulting slot, said second wire will tend to deflect, in opposite transverse directions, the first and second plates which will in turn tend to bring together the first and second sides of the resulting lower slot defined respectively by the second and first plates.

In accordance with another form of the invention the connecting offsetting portions of the two slots are staggered or serial separated with respect to each other along the longitudinal axes thereof in such a manner that a conductor will pass through the offsetting portion of one slot before entering to offsetting portion of the other slot, and in this manner maintain the width of the passageway over which the wire moves nearly constant and equal to the width of each of the two slots along their straight portions; i.e., their upper and lower stages.

In yet another form the actual widths of the upper slot stages are wider than that of the lower slot stages, and the width of the resultant upper slot stage is greater than that of the resultant lower slot stage. With the foregoing configuration the upper slot stage can receive and retain a wire of substantially greater diameter than that retainable by the lower slot stage.

In accordance with still another form of the invention the slots in the two plate-like elements can be formed in three stages extending from the second or free ends of the two plate-like elements and with the first and third stages of the slots in each plate being aligned with each other, but being offset with respect to the first and third stages in the other plates, and with the second or center stages, which connect together the first and third stages, being offset with respect to the first and third stages in opposite directions with respect to each other. The resultant slot formed by the two first stages, the two second stages, and the two third stages is a long, narrow slot whose width is slightly less than the diameter of the metal conductors of the wires to be inserted therein, and with each of the three stages being capable of receiving at least one wire.

In accordance with a feature of the invention the slots can open onto the side of the two plate-like elements opposite the bent over junction of the elements, or onto the bent over junction itself or, alternatively, on either side of the plate-like elements so that said slots will be substantially parallel with the bent over junction.

BRIEF DESCRIPTION OF THE DRAWINGS

The above-identified and other objects and features of the invention will be more fully understood from the following detailed description thereof when read in conjunction with the drawings in which:

FIG. 10 is a perspective view of another form of the invention in which two plates of slotted metal are connected together at the ends thereof at which the slot begins;

FIG. 11 is a front view of the structure of FIG. 10;

FIG. 12 is a side view of the structure of FIG. 10;

FIG. 13 is a view of the blank from which the structure of FIG. 10 is formed;

DETAILED DESCRIPTION OF THE INVENTION

Figure 1:
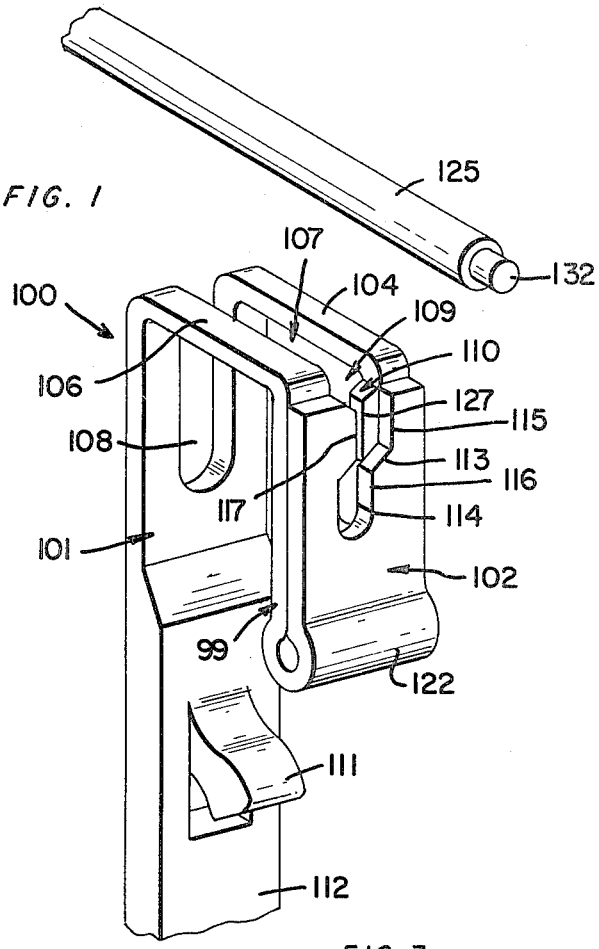
FIG. 1 is a perspective view of one form of the terminal employing a two stage slot and with a conductor poised thereabove to be inserted into the said slot.

Referring now to FIG. 1 there is shown a form of the invention 100 in which a metal clip is formed into a generally U-shaped configuration having a leg 101 of single thickness and a second leg of two plate thicknesses 102 and 99 joined together by a transverse section. The transverse section is divided into two sections 106 and 104 by means of slot 107 formed therein and which extends down into the leg 101 as slot 108 and also extends down into the double thickness legs 99 and 102 as two staged slots 109 and 110. The double walled leg 99 and 102 is joined at junction 122. Considering first the leg 102, the two stage slot 110 consist of an upper stage 115 extending from the upper end of leg 102 down towards the junction 122 and a lower stage 114, which is offset with respect to the upper stage 115 by means of an offsetting portion 113. A second two stage slot 109 is formed in the leg 99 and consists of an upper stage 120 (see FIG. 2) and a lower stage 121, with the lower stage 121 being offset with respect to upper stage 120.

It is to be noted that the two offset lower stages 114 and 121 are offset in different directions with respect to each other and with respect to the upper stages 115 and 120.

The two upper stages 115 and 120 in front plate 102 and back plate 99, respectively, are offset with respect to each other to provide one resultant composite narrowed slot 135, the left side of which is formed by the inner edge 117 of the bifurcated end of front plate 102 and the right side of which is formed by the inner edge 127 of the bifurcated end of rear plate 99. Such narrowed slot has a width less than the diameter of the conductive portion 133 (see FIG. 6) of conductor 140 to be inserted therein.

In a similar manner the two lower stages of the slots 110 and 109 in front plate 102 and back plate 99 form a single, narrowed resultant composite slot 136 with the left hand side formed by the inner edge 126 (FIG. 2) of the bifurcated end of plate 99 and the right hand side formed by the inner edge 116 of the bifurcated end of front plate 102.

Figure 5:
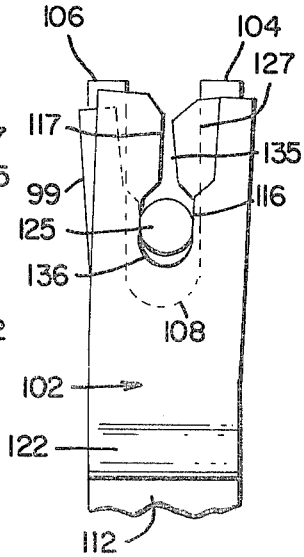
FIG. 5 is another front view of the structure of FIG. 3 but with the conductor fully inserted into the second stage thereof and showing the deflection of the two plate-like members forming the slotted terminal.

The narrowed slot formed by the two lower stages of slots 109 and 110 has a width less than the diameter of the conductive portion 132 of conductor 125 which is to be ultimately inserted therein, as shown in FIG. 5.

The slot 108 in the single thickness leg 101 is shown most clearly in FIG. 1 and has a width which can be slightly less than the total diameter of the conductor 125, including the plastic coating thereof, to form a strain relief function. Alternatively, the slot 108 can be sufficiently side so as to freely admit the conductor 125 and the strain relief function desired can be formed by some other means, such as a housing into which the contact 100 is retained.

Figure 9:
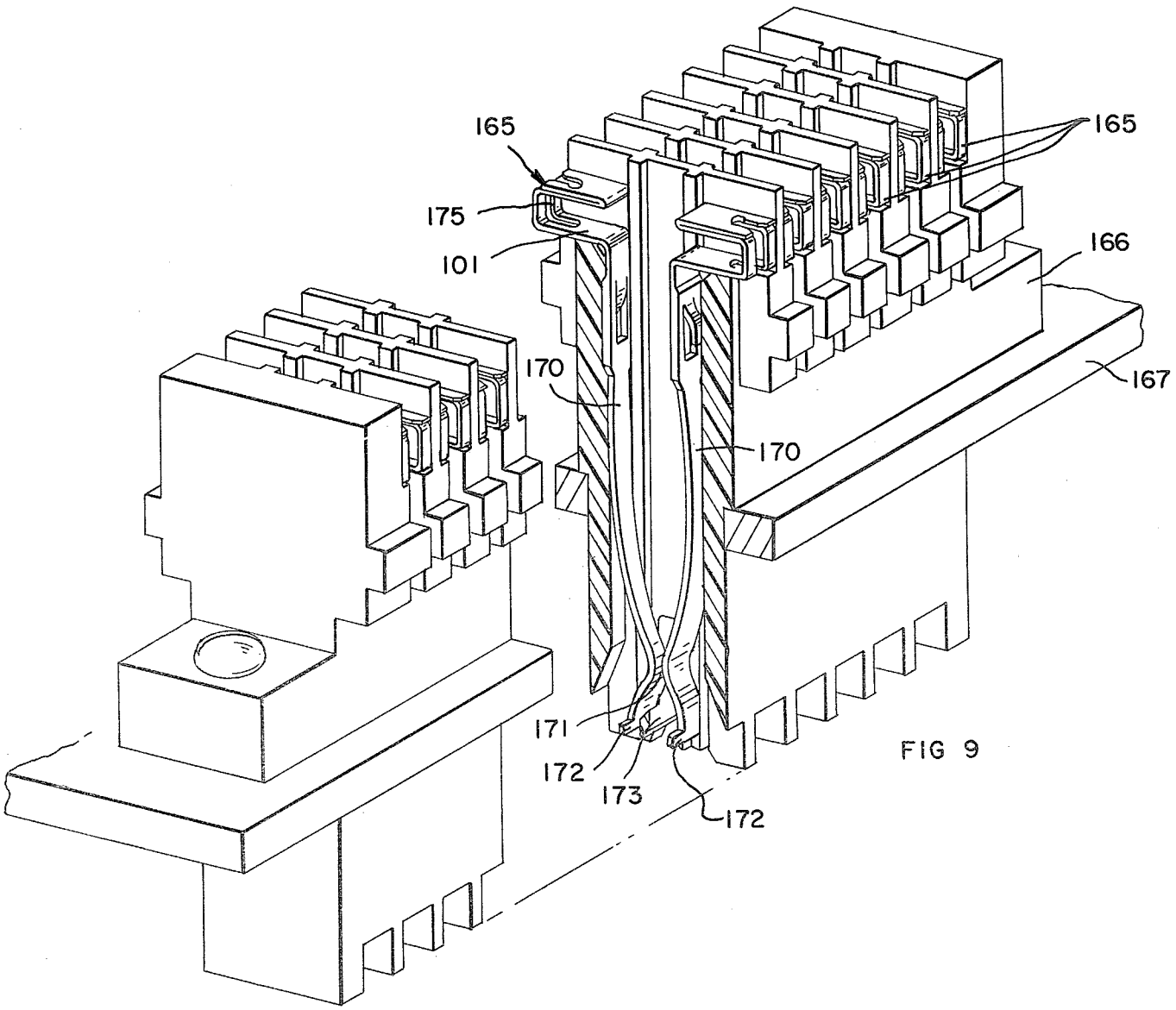
FIG. 9 is a perspective view of another connector employing the slotted terminals of the type similar to the type shown in FIGS. 1 through 7.
Figure 8:
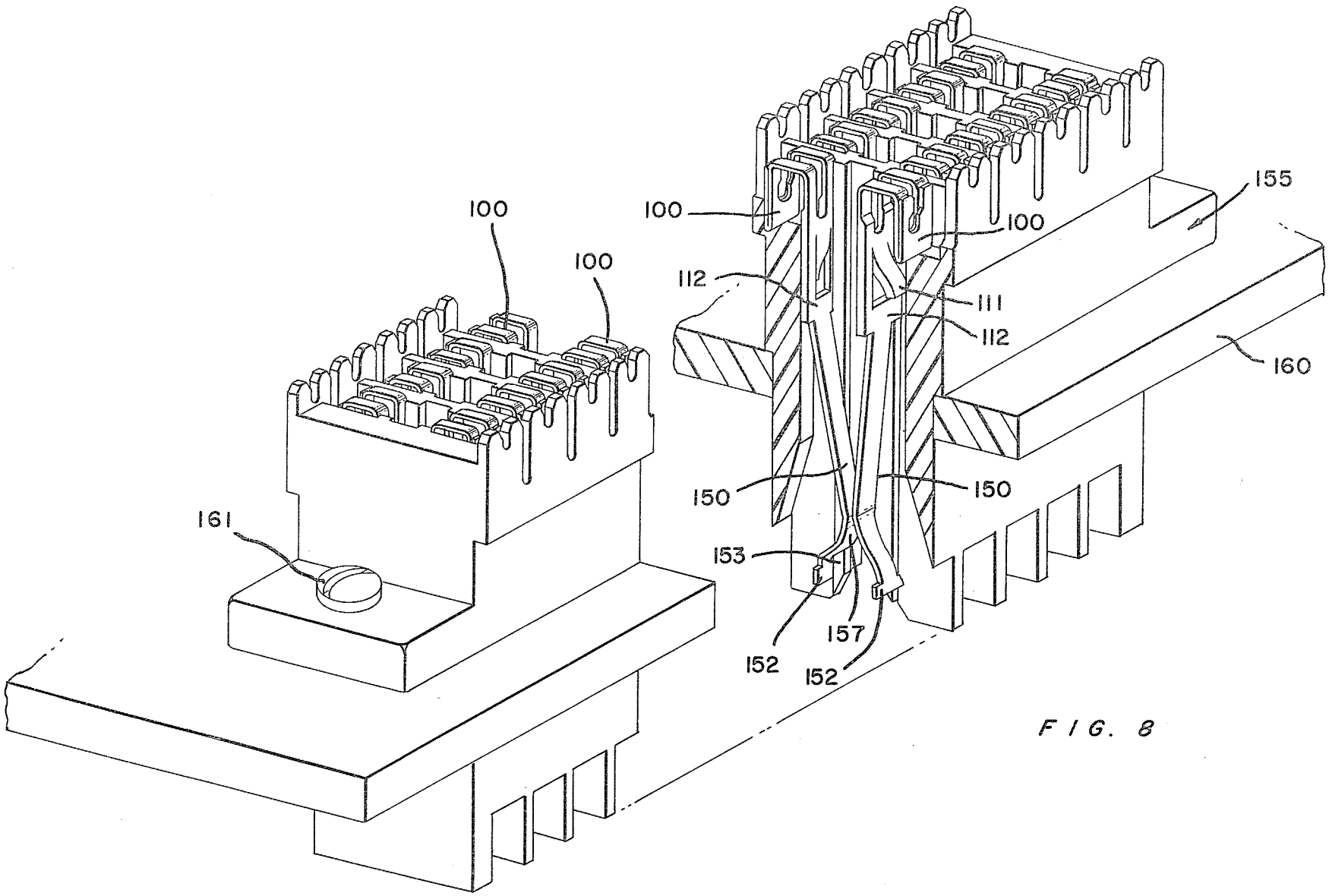
FIG. 8 is a perspective view of a connector employing a slotted terminal of the type shown in FIGS. 1 through 7.

Still referring to FIG. 1 the leg 101 of the U-shaped terminal has an extension 112 thereon which can be formed in the shape of a terminal post or a spring leaf contact, as shown in FIGS. 8 or 9. A lance 111 can be formed from the extended portion 112 of leg 101 to perform the function of locking the terminal in the housing, also as shown in FIGS. 8 and 9.

Figure 2:
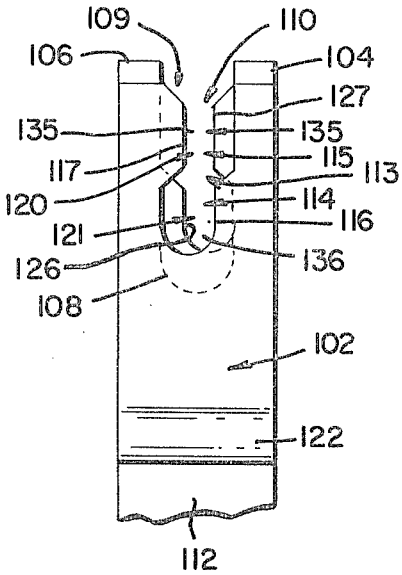
FIG. 2 is a front view of the slotted portion of FIG. 1 showing in more detail the relationship of the two stages of the slots in the two plate-like members.
Figure 3:
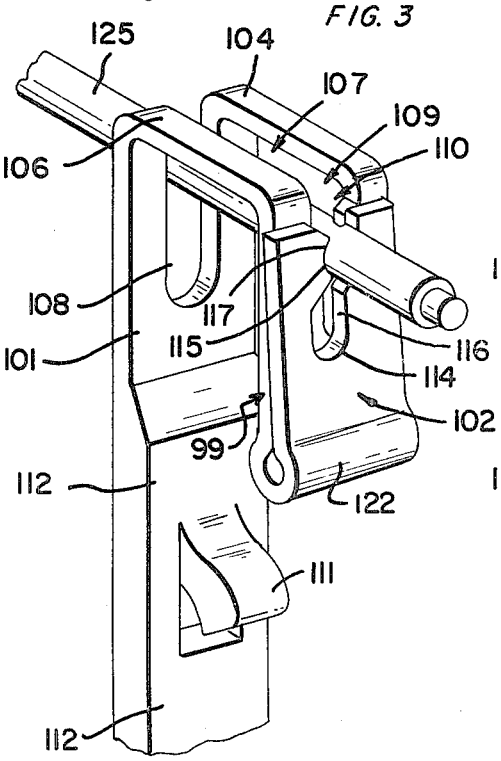
FIG. 3 is a perspective view of the structure of FIG. 1 but with the wire inserted into the top or first stage of the slot.

It is to be noted that in both FIGS. 1 and 2 the terminals are shown without a wire being inserted therein. In FIG. 3 the conductor 125 is shown inserted in the upper stages 115 and 120 of plates 102 and 99 respectively. Since the overall diameter of the conductor 125 is greater than the narrow slot produced by the offset relationship of the two upper stages of slots 109 and 110, the said conductor 125 will force the outer plate 102 slightly to the left, as shown in FIG. 3, thereby creating a spring-like force on conductor 125. The inner edge 117 of the bifurcated plate 102 is shown as having dug into the outer plastic coating of conductor 125 during insertion thereof into the upper stages of slots 109 and 110.

Figure 4:
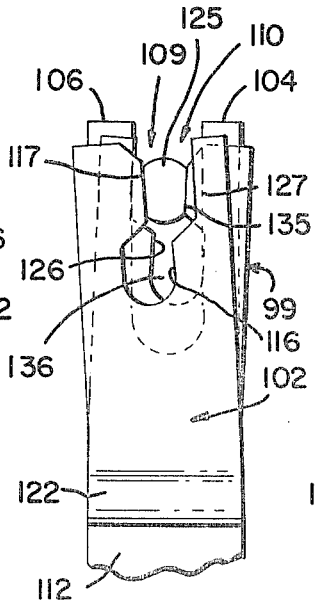
FIG. 4 is a front view of the structure of FIG. 3 showing the single conductor inserted in the top stage of the slot and the deflection created thereby in the two plate-like elements.

FIG. 4 shows a front view of the structure of FIG. 3 with the wire conductor 125 in the upper stages of the two slots 109 and 110. The deflection of the outer plate 102 to the left with respect to the position of the inner plate 99 can be seen clearly in FIG. 4. The presence of conductor 125 in the upper stages of slots 109 and 110 functions to decrease the width of the resulting narrow slot 136 formed by the lower stages of the two slots 109 and 110.

When the wire conductor 125 is fully inserted into the lower slot 136 formed by the two lower stages of slots 109 and 110, as shown in FIG. 5, the width of the upper resulting narrow slot 135 formed by the upper stages of slots 109 and 110 is decreased.

Figure 6:
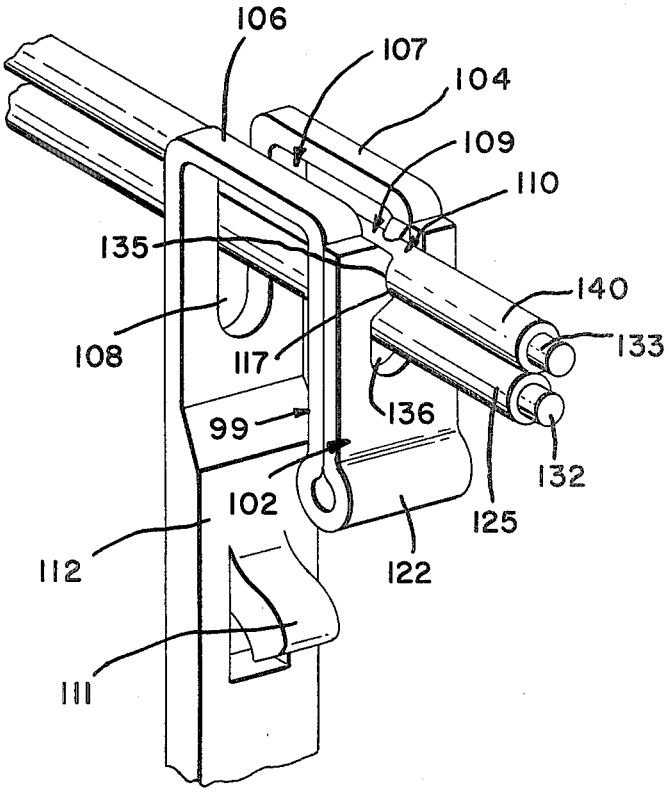
FIG. 6 is a third perspective view of the structure shown in FIGS. 1 and 2 but with two conductors inserted respectively in the first and second slots thereof.

FIG. 6 shows the contact of FIGS. 1 through 5 with a second conductor 140 inserted in the upper stages of the two slots 109 and 110. The presence of the second conductor 140 tends to push apart the resulting slot formed by the front plate 102 and the rear plate 99 as can be seen more clearly in the front view of FIG. 7, thus tending to equalize the lateral forces retaining the two conductors 140 and 125 within the upper and lower stages of the two slots 109 and 110 respectively.

Figure 7:
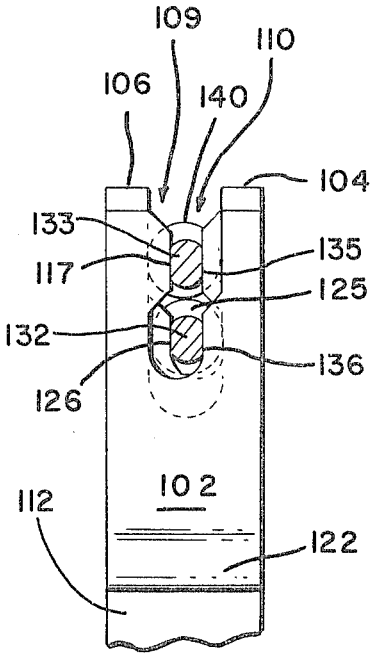
FIG. 7 is a front view of the structure of FIG. 6 showing the two wires inserted in the first and second stages thereof and the deflection of the two plate-like members forming the slotted terminals.

The presence of the two conductors 140 and 125 in the two stages of slots 109 and 110 results in greater lateral retention forces on the two conductors 140 and 125 than would be applied against only a single conductor 125 inserted in the slot as shown in FIG. 5. In contact 100 the junction 122 acts as a spring connection tending to maintain the two plates 102 and 99 in alignment. The presence of a single conductor 125 in the resulting slot tends to move the front plate 102 either to the left or to the right with respect to the rear plate 99 depending upon whether the conductor is in the upper stages of slots 109 and 110 or in the lower stages thereof. When conductors are inserted in both the upper and lower stages of slots 109 and 110, as shown in FIG. 7, the joining member 122 maintains the lower ends of the two plates 102 and 99 in alignment and the presence of the two conductors maintains the upper ends of the two plates 102 and 99 in alignment. Accordingly, since the resulting or composite narrow slots 135 and 136 have widths less than the diameter of the conductive portions 133 and 132 of conductors 140 and 125, the edges of the said composite slots 135 and 136 will bite through the insulative coating and into the metal conductive portions of the said conductors 125 and 140.

Referring now to FIG. 8 there is shown one form of a connector employing the embodiment of the invention shown in FIGS. 1 through 7. In FIG. 8 the upper, slotted end of each of the terminals is represented generally by reference character 100 and corresponds to the terminal shown in FIGS. 1 through 7. The terminals of FIG. 8 are mounted in a plastic connecter housing 155 which in turn can be mounted on a substrate 160 by suitable means such as a bolt 161.

Each pair of the terminals 100 has its portions 112 extended to form a pair of spring leaf contacts 150 which converge towards each other to form contact areas 157 between which a terminal post or the edge of a printed circuit board can be inserted, if an elongated slot is provided therefor in the bottom of housing 155. The ends 152 of terminals 100 have ears formed thereon which fit behind shoulders 153 formed in plastic housing 155 to provide a preloaded condition of the leaf spring contacts 150.

It is to be noted that the extensions 112 can be other than spring leaf contacts. For example, they can be formed into crimping barrels or terminal posts or any other desired type of contact or wire terminating means.

In FIG. 9 there is shown a somewhat different adaption of the terminal of FIGS. 1 through 7 in a connector housing 166. More specifically, the U-shaped terminating portion 101 of the contacts 165 are positioned so that wires are inserted in the slots 175 therein in a direction perpendicular to the mounting plate 167 as compared with the horizontal positioning of the wires with the substrate or mounting board 160 of FIG. 8. Otherwise, the structure 165 of FIG. 9 is quite similar to that of FIG. 3 with the extended portions of the single thickness legs 170 of the terminals forming spring leaf contacts which converge at the areas indicated by reference character 171 and between which converging areas a terminal post can be inserted. Alternatively, if a slot is provided in the housing 166, the edge of a printed circuit board can be inserted, with respect to the converging areas, therebetween. The ends of the leaf spring contacts 170 can have ears or tabs 172 which fit behind shoulders 173 formed in the plastic housing 166.

In FIG. 10 there is shown another form of the invention consisting of two plates 181 and 182 folded over at junctions 183 and 184. The slot 189 opens onto the junction end, as compared with opening onto the non-junction end as shown in FIG. 1.

As in FIG. 1 each of the plates 181 and 182 has a two stage slot formed therein with the upper stages of the slots offset with respect to each other to form a resultant upper composite narrowed slot 190, and with the lower stages being offset from the upper stages but in opposite directions to form a second composite resultant lower narrowed slot 191. As in the case of the structure of FIG. 1 the upper narrowed slot 190 has the left hand edge thereof formed by the rear plate 182 and the right hand edge thereof formed by the front plate 181 whereas the narrow resulting slot 191 the lower stages is formed at the left hand side by the front plate 181 and at the right hand side by the rear plate 182.

Either of the plates 181 or 182 can be extended to form a contact, such as the leaf spring 150 of FIG. 8, or a terminal post, a crimping barrel or some other desired structure. If formed into a leaf spring and substituted for those as shown in either FIG. 8 or FIG. 9 the resulting contact can be inserted into the housing 155 of FIG. 8 from the bottom thereof because of the small size of the slotted end. The contacts actually shown in FIGS. 8 and 9, however, must be inserted from the top of the housing 155 because of the folded over U-shaped configuration at the slotted ends of the terminals. If the contact of FIG. 10 is employed in the housing of the type shown in FIG. 8 such housing 155 must be modified to adapt to the configuration of the slotted end of the terminal. Further, a leaf spring extension of the plate 182 can be formed on a common carrier and gang-inserted into a housing of the type shown in FIG. 8 or FIG. 9.

In FIG. 11, which is a front view of the structure of FIG. 10, the relationship of the slot in the front plate 181 with the slot in the rear plate 182 can be more clearly seen. Such relationship is substantially the same as the relationship of the slots in the front plate 102 and the rear plate 99 of FIG. 1, except that the slots enter the plates from the joined end in FIG. 11 whereas the slots enter into the end of the plates from the non-joined end in FIG. 1. A conductor 195 is inserted into slot 189 in the direction of arrow 196.

In FIG. 12 there is shown a side view of the structure of FIG. 10 with corresponding parts thereof being identified by the same reference characters.

FIG. 13 shows the stamped blank of the terminal shown in FIG. 10. It is evident from FIG. 13 that the terminal can be formed by stamping a single piece from a strip of metal, whereas in the structure of FIG. 1, at least two stampings are required since the slot in the front plate 102 is separated from the slot in the rear plate 99 by a solid section of metal which includes the junction portion 122.

Figure 14:
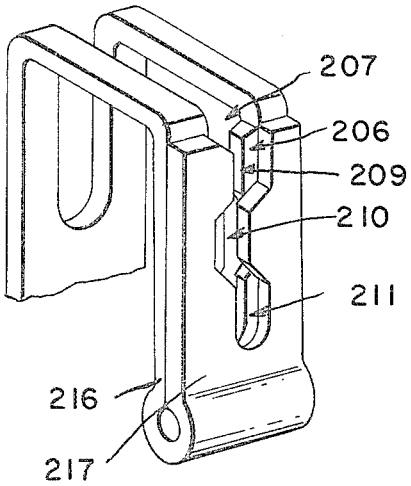
FIG. 14 shows a perspective view of another form of the invention in which a three stage slot is employed.

In FIG. 14 there is shown another form of the invention similar to that of FIG. 1 except that the resulting or composite slot in the structure of FIG. 14 has three stages 209, 210, and 211 formed therein. The top stages of the slots 206 and 207 formed in the two plates is identified generally by reference character 209, the middle stages by reference character 210 and the bottom stages by reference character 211. It can be seen that the upper and bottom stages 209 and 211 of the slot in any one of the plates are aligned mutually with each other, but are offset with the respective upper and bottom stages in the other plate, to produce a narrow composite resulting slot in the upper and bottom stages. The slots forming the middle stage 210 are offset with respect to the upper and bottom slots in any one plate, in opposite directions with respect to each other, as can be seen in FIG. 15.

Thus, the upper and bottom stages 209 and 211 have their left hand sides or edges formed by the front plate 217 and their right hand sides or edges formed by the rear plate 216. The middle slot stage 210, however, has its left hand edge formed by the rear or back plate 216 and its right hand edge formed by the front plate 217. Thus, when wires are inserted in all three stages of the slot the wires in the upper and bottom slots will tend to move the front plate 217 to the left in FIG. 15 and the rear plate 216 to the right. However, a conductor positioned in the middle stage 210 will tend to force the front plate 217 to the right and the rear plate 216 to the left in opposition to the forces on plates 216 and 217 created by the conductors in the upper and lower stages 209 and 211.

Figure 15:
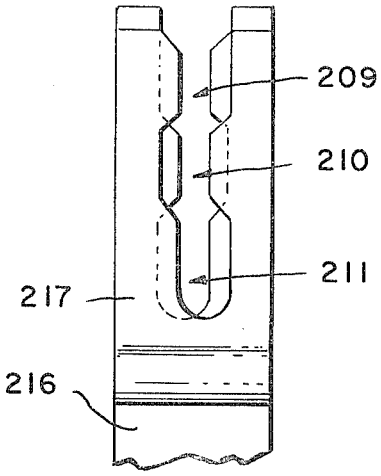
FIG. 15 shows a front view of the structure of FIG. 13 to show the relationship between the three stage slots formed in the two metal plate-like elements.
Figure 17:
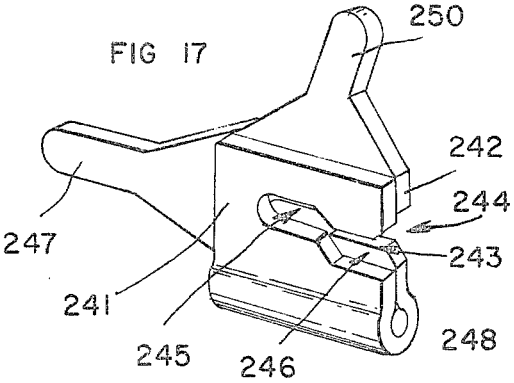
FIG. 17 is a perspective view of another form of the invention in which the joined portion of the two plate-like elements is at the side thereof with respect to the slotted portions as opposed to the ends opposite the ends into which the slots extend.
Figure 17:
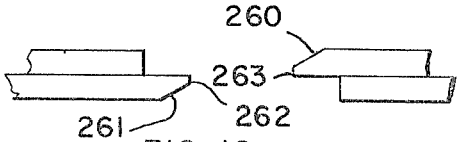

While the structure of FIGS. 14 and 15 show the slots 206 and 207 opening onto the non-joined edge of the terminal it is to be understood that they can also open onto the joined edge as shown in the structure of FIGS. 10 through 13, or alternatively, they can open onto the side with respect to the joined edge of the two plates, as shown in FIG. 17, which has not yet been discussed in detail.

Figure 16:
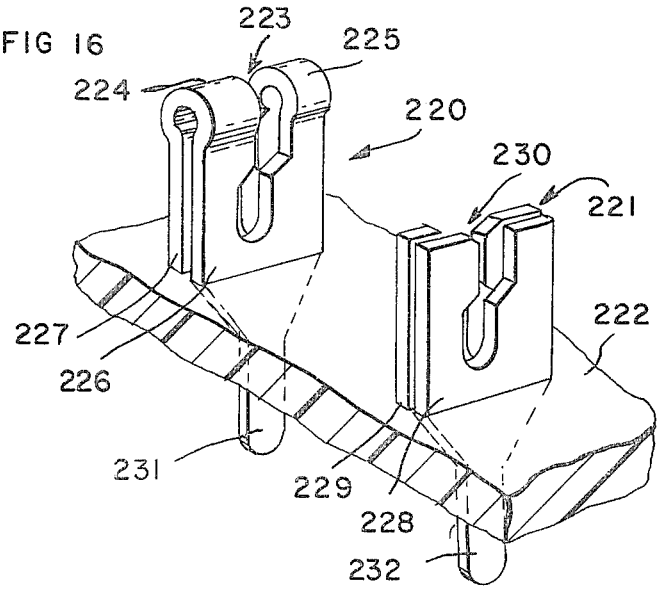
FIG. 16 is another form of the invention showing the invention embedded in a plastic base.

In FIG. 16 there is shown an embodiment of the invention embedded in a plastic substrate 222. The embodiment 220 is similar to that shown in FIG. 10 and comprises a pair of plates 226 and 227 joined integrally by a folded junction bifurcated by a slot 223 to form a pair of folded sections 224 and 225. The plate 226 extends through the plastic substrate 222 and can be formed into a desired terminal such as a post 231, for example.

In FIG. 17 there is shown yet another form of the invention in which the slots 243 and 244 formed in the plates 241 and 242 have their upper stages offset with respect to each other to form a narrowed resulting or composite slot in the upper stage 246. Similarly, the two lower stages of the two slots 243 and 244 are offset with respect to their upper stages and offset in opposite directions with respect to each other, in the same manner as discussed in connection with FIG. 1. The resultant narrowed slot stages 246 and 245 each a width less than the diameter of the conductive portion of the conductors to be inserted therein.

The two plates 241 and 242 are joined at junction 248 which can be seen to be longitudinally parallel with the slots 243 and 244. Either plate 241 or plate 242 can be extended in any of three directions to provide additional terminating means, such as terminal posts 247 or 250, or crimping barrels or spring leaf contacts. In a similar manner, one of the plates in the embodiments shown in FIGS. 1, 10 and 15 can be extended in different directions.

Figure 18:
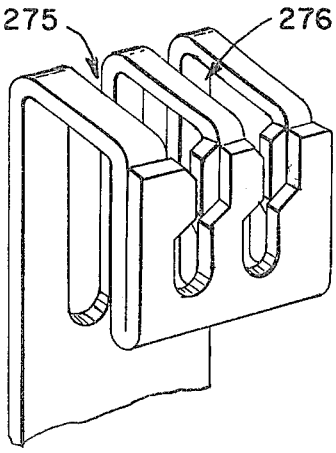
FIG. 18 shows a form of the invention in which two pairs of two stage slots are formed side-by-side in the same terminal to accommodate four conductors.

In FIG. 18 there is shown an embodiment of the invention incorporating pairs of slots 275 and 276 in a single terminal, with each pair of slots comprising an upper and a lower stage so that the terminal can accommodate four conductors, two in each slot.

While the narrowed slots in each of the stages in all of the embodiments shown are indicated as having equal widths, such widths actually can be different in different stages of the same slot. For example, in the embodiment shown in FIG. 1 the width of the narrow composite upper stage can be either greater or less than the width of the narrow composite lower stage to accommodate two wires of different diameters. Similarly, the widths of the three stages of the embodiments shown in FIG. 15 can be different to accommodate three wires of different diameters. Further, the edges of the slot stages can be curvilinear in shape rather than straight.

Figure 19:
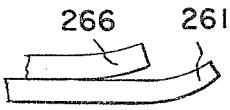
FIG. 19 shows a means of forming the edges of the slots.

In FIG. 19 there is shown a means which involves shaping the edges of the plates which form the slots to reduce the localized torque exerted on the conductor by said edges. More specifically, the plate edges 260 and 261 are beveled on opposite sides thereof so that the end portions 262 and 263 thereof will come in contact with the conductor aligned more nearly in a plane normal to the wire length than would be the case if such ends were not beveled.

Figure 20:
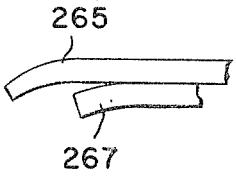
FIG. 20 shows another means of forming the edges of the slots.

In FIG. 20 a still further modification is made in the edges of the slotted plates that form the slots to reduce the localized torque on the conductor inserted therebetween. The two edges 264 and 265 are not only tapered but also are bent towards one another so that the plane of contact between the edges of the two elements 264 and 265 is nearly normal to the axial length of the conductor inserted therein, thereby reducing the localized torque to virtually zero. To permit lateral movement of the edges 264 and 265 away from each other as the conductor is inserted therebetween, the plates forming slot edges 266 and 267 are bent away from edges 264 and 265, respectively, to permit such lateral movement of said edges 264 and 265.

Referring now to FIGS. 21 through 28 there is shown another form of the invention in which the offsetting portions of the two slots from the first stage to the second stage are not coincident but rather are staggered or serial with respect to each other along the longitudinal direction of the slots. The coaction of such a slot configuration and a wire as it is inserted into the slot configuration is shown in progressive stages in FIGS. 21 through 25.

Figure 21:
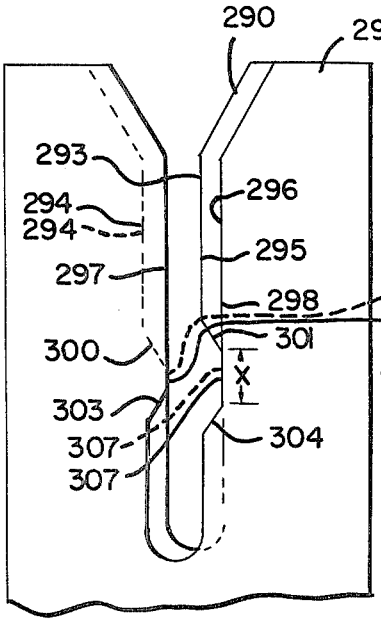
FIG. 21 shows another form of the invention wherein the offsetting portions of the two slots are staggered or serial with respect to each other along the longitudinal axes of the slots.

In FIG. 21 the slot 293 formed in plate 290 is defined by edges 294 and 295 and the slot 296 formed in plate 291 is defined by edges 297 and 298. The diagonal offsetting portion of slot 293 is defined by the diagonal edges 300 and 301 of plate 290 and is located above the diagonal offsetting portion of the slot 296 which is defined by the diagonal edges 303 and 304 of plate 291. The distance X between the lower end of the offsetting portion of slot 293 and the upper end of the offsetting portion of the slot 296 is sufficiently great to permit a wire to pass through the offsetting portions of the slots and abut the commonly aligned edge portions 307 of the slots along the distance X and abut the commonly aligned edges 308 of the slots opposite the edges 307 of the slots without being pinched between the offsetting edges 301 and 304 of slots 293 and 296.

Figure 22:
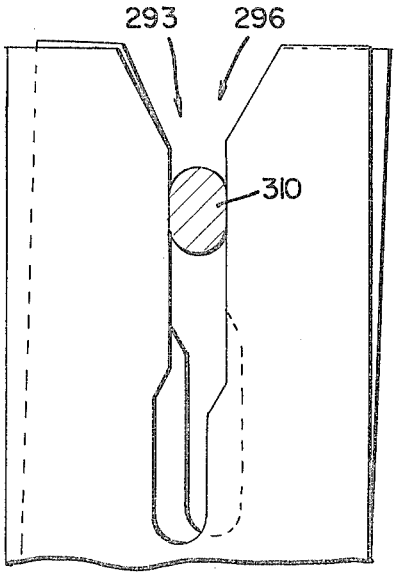
FIGS. 22, 23, and 24 show the movement of the edges of the two slots as a conductor is inserted into the upper stage and down through the offsetting portions and into the lower stages of the two slots.

The entry of a conductor 310 into the upper stages of slots 293 and 296 is shown in FIG. 22 and can be seen to force the edges of the upper stages of the two slots 293 and 296 into substantially alignment.

Figure 23:
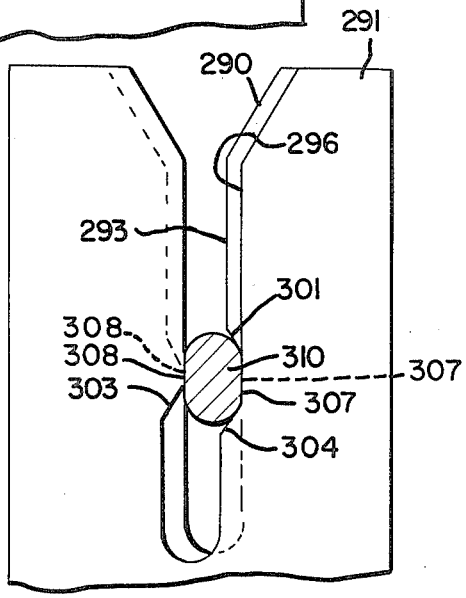

As the conductor 310 is moved further down into the slots 293 and 296 and between the offsetting portions of the two slots, the conductor 310 and the two slots will assume the relative positions shown in FIG. 23. It is apparent from FIG. 23 that the staggering of the offsetting portions of the two slots 293 and 296 produces a resulting slot or passageway of maximum and constant width for conductor 310 as it passes along the slots from one to the other of said offsetting portions of the two slots.

Figure 24:
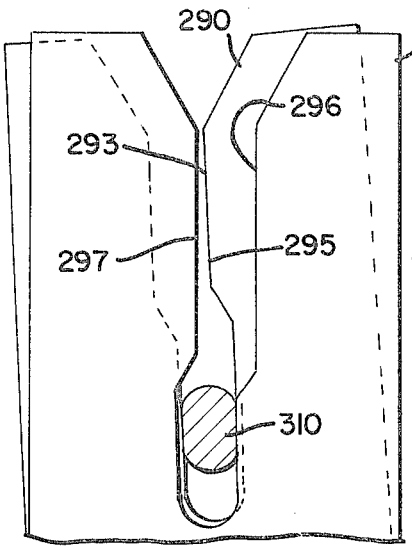

In FIG. 24 the conductor 310 is shown after having passed through the two offsetting portions of the two slots 293 and 296. As in the case of the description of operation with respect to the structure of FIGS. 4 and 5, the presence of conductor 310 in the lower stages of the two slots 293 and 296 causes the upper edge 297 of plate 291 and the upper edge 295 of plate 290 to move towards each other to form a narrowed resultant upper stage slot.

Figure 25:
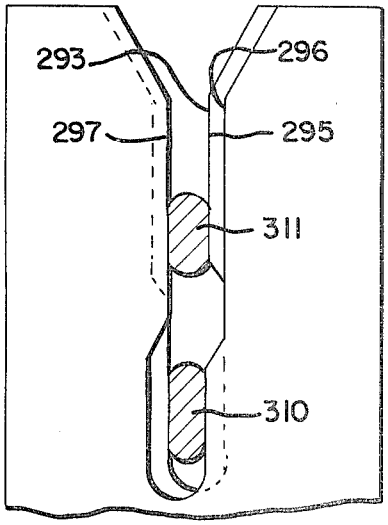
FIG. 25 shows the relationship of the edges of the two slots after a second conductor has been inserted into the upper stages thereof.

In FIG. 25 a second conductor 311 has been inserted in the top stages of the two slots 293 and 296 to force the edges 297 and 295 of slots 296 and 293 apart, thereby forcing together or tending to force together the edges of the two plates which define the resultant lower stage slot.

Figure 26:
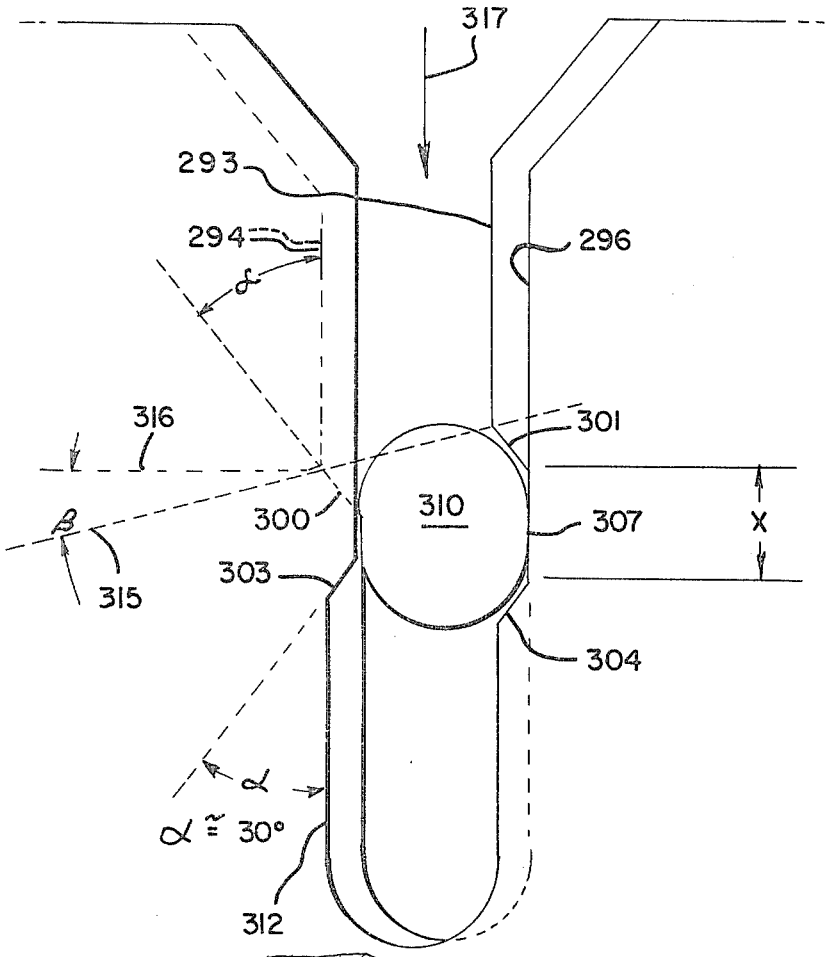
FIG. 26 is an enlarged view of a portion of FIG. 23.

In FIG. 26 there is shown an enlarged view of the center portion of FIG. 23. In FIG. 26 the angle $\alpha$ defines the angle between the edges of the offsetting portions, such as edges 303 and 300, and the straight edges, such as edges 294 and 312 of the upper and lower stages of the slots. Although a value of 30 degrees for angle 60 has been found to provide a passageway of near minimum resistance for a wire passing through the offsetting portions, 60 can vary above or below 30 degrees by several degrees and still produce suitable operating results. The angle $\beta$, which defines the angle between the dotted line 315 joining together the upper ends of the edges 300 and 301 of the offsetting portion of slot 293, and the dotted line 316, which is perpendicular to the longitudinal axes of the slots, will produce satisfactory operating results with a value of 12 to 20 degrees.

As discussed above briefly in connection with FIG. 23 the distance X should be sufficiently large to permit the conductor 310, which has been somewhat ovalized by the time it reaches of offsetting portions of the slots, to pass along the slots from one to the other of said offsetting portions without being pinched between the two offsetting edges 301 and 304.

With the staggering or serial spacing of the offsetting portions of slots 293 and 296 along the longitudinal axes of said slots the width of the passageway between the offsetting portions for the conductor 310 remains substantially equal to the width of either one of the slots 293 and 296. It is to be noted that in most configurations of the invention the width of each of the slots 293 and 296 will be the same although in certain applications the width of either the upper or the lower stages, or both stages, of the two slots can be different.

It is to be further noted that the staggering of the two offsetting portions of the two slots 293 and 296 can be employed in any of the other embodiments of the invention shown herein.

Figure 27:
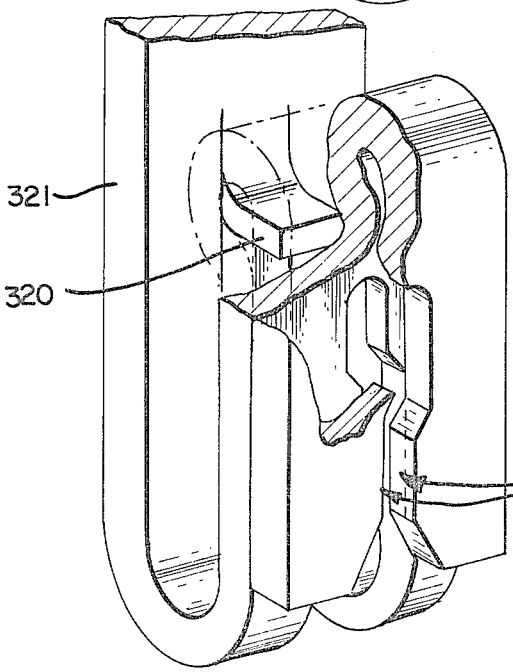
FIG. 27 is an isometric view of a form of the invention employing the slots with the staggered offsetting portions and also employing a stop means for determining the depth of insertion of a wire into the slots.

A form of the invention employing the staggered offsetting portions of the two slots is shown in the isometric view of FIG. 27. An added feature of the structure of FIG. 27, not shown in other views of the invention, is the stop element 320 which can be formed out of the bent back portion 321 of the contact. As a wire is inserted vertically upward into the two slots, designated generally by reference character 322, it will come to rest against the stop element 320 to precisely limit and thereby determine the depth of insertion of the wire into the slots 322. It is apparent that the use of stop means 320 can be employed in the other forms of the invention shown herein.

Figure 28:
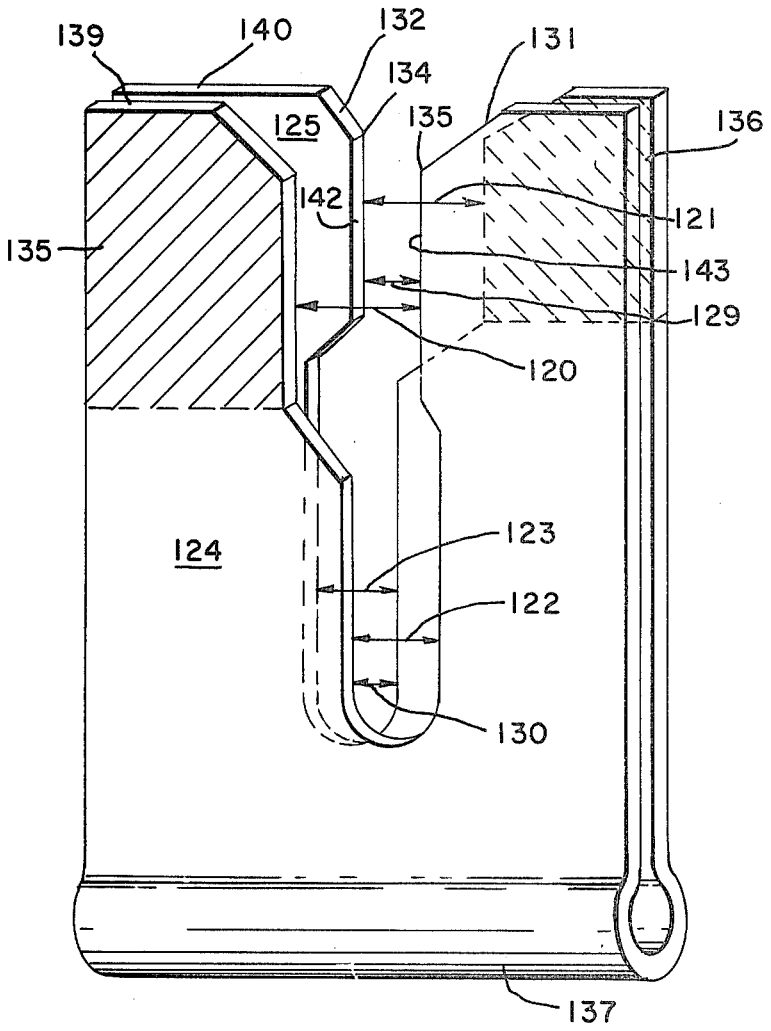
FIG. 28 is an isometric view of yet another form of the invention.

In forms of the invention in which the two plates are joined at the edge opposite that edge into which the slots enter, certain portions of the plates can be eliminated if desired. For example, in FIG. 28, the shaded portion 135 of the front plate 124 can be removed, and the shaded portion 136 of the rear plate 125 can be removed without any appreciable change in the operation of the structure. More specifically, the front and rear plates 124 and 125 of FIG. 28 are joined together at doubled over or folded over edge 137 which is opposite the edges 139 and 140 of the plates 124 and 125 and into which edges slots 120 and 121 extend. It is apparent from FIG. 28 that the edge 142 of plate 125 and edge 143 of plate 124 form the two sides of the resultant upper stage slot 129. The shaded portions 135 and 136 of plates 124 and 125 are not needed.

In the invention, also as shown in FIG. 28, the widths of the upper stages of the actual slots 120 and 121 of the plates 124 and 125 respectively can be different than the widths of the lower stages 122 and 123 of the slots, and the offsetting portions of the slots can be selected and adjusted so that the resultant lower stage slot width 130 is less than the resultant upper stage slot width 129. With such an arrangement the resultant lower stage slot will retain a wire of a diameter less than the diameter of the wire which can be retained in the resultant upper stage slot 129. It is to be noted that slot stages and slot widths are denoted by the same reference characters.

The flared lead-in edges 131 and 132 of plates 124 and 125 can be of different angles so that the entering wire meets the corners 134 and 135 at different times, thereby lowering the forces resisting insertion of the wire into the slots.

Figure 29:
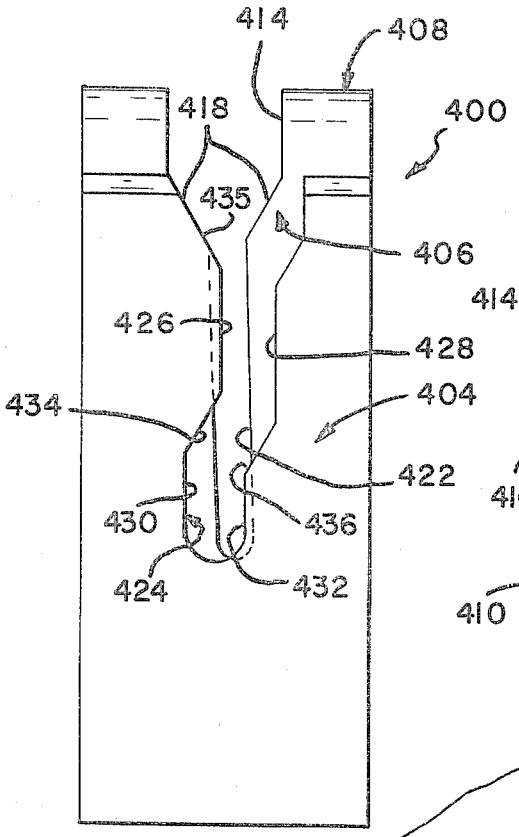
FIG. 29 is an enlarged elevation of another preferred embodiment of an electrical terminal having two pivotally connected metal plates, each provided with a slotted opening.
Figure 30:
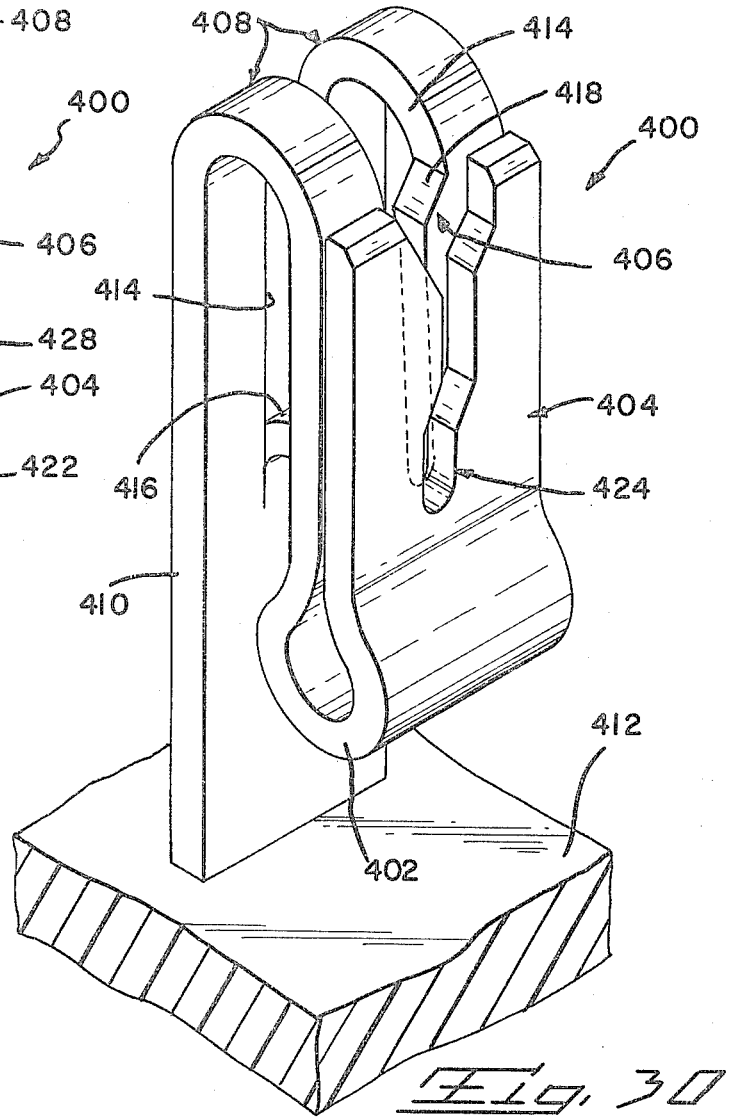
FIG. 30 is a perspective of the preferred embodiment of FIG. 29.

FIGS. 29 and 30 illustrate another embodiment of an electrical terminal generally indicated at 400 which is fabricated from a metal strip. The strip is doubled over upon itself in a direction transversely of its length along an arcuate bight 402, thereby to provide a pair of generally planar plate portions 404 and 406 closely adjacent to each other. The strip is again doubled over upon itself along a second bight 408 to provide a generally planar elongated leg portion 410 which is generally parallel with and spaced from the plate portion 406. The leg 410 is illustrated as being secured such as by embedding in a plastic base portion 412 which serves to support the terminal 400. Other suitable bases and techniques for mounting the terminal thereto are permissible.

The leg 410 further is provided with an elongated wire-receiving opening 414 as shown in FIG. 30, along an upper portion of the leg 410, terminating at a metal tab 416. The tab 416 is formed first in the plane of the leg 410 and is bent to project outwardly therefrom into the space between the leg 410 and the plate portion 406 serving as a wire stop.

Yet with reference to FIG. 30 in conjunction with FIG. 29, the wire-receiving opening 414 also bifurcates the bight portion 408 and further defines an open ended slot along a substantial length of the plate portion 406. The open ended slot is defined by a pair of tapered sidewalls 418 at the junction of the bight 408 and plate portion 406. The slot further is defined by a pair of elongated, parallel opposed and straight wire slicing edges 420 and 422 which adjoin corresponding sidewalls 418.

The plate portion 404 also is provided with an open ended elongated slot generally shown at 424. The slot 424 overlies the open ended slot of the adjacent plate portion 406. Both slots coextend for a substantial portion of their lengths so that one or, alternatively, a pair of insulation covered wires which are to be terminated or connected electrically in the terminal 400 will pass through both slots. The slot 424 has an upper wire receiving stage defined between parallel opposed slot edges 426 and 428. The slot edge 426 provides a wire slicing edge and projects beyond the corresponding edge 420 of the slot of the plate 406 in a direction toward the opposite slot edge 428, and defines a first wire receiving opening, common to both plates 404 and 406 and having a width defined between the slicing edge 426 and the slicing edge 422, which width is less than the width of the slot 424 and less than the diameter of a conductor portion of an insulation covered wire to be terminated or connected in the terminal 400.

The slot 424 is provided with another wire receiving stage defined between opposite parallel and linear slot edges 430 and 432. The edge 432 projects outwardly beyond a corresponding slot edge 422 of the plate 406 in a direction toward the opposed slot edge 430 and defines another common wire receiving opening passing through both slots and the corresponding plates 404 and 406. The width of this common wire receiving opening is defined between the slicing edge 432 and the slicing edge 420, which width is less than the width of the slot 424 and less than the diameter of a conductor portion of an insulated wire to be terminated or connected in the terminal 400. The two stages of the slot 424 are spaced axially along the length of the slot and are interconnected by a diagonally oriented portion of the slot which is defined between the diagonal slot edges 434 and 436. The diagonal edge 434 adjoins the slot edge 430 and also the slicing slot edge 426 and defines the lower terminus of the slicing edge 426. The upper terminus of the slot edge 426 is defined by a diagonal edge 435 which initially is in coincident alignment with a sidewall 418. Similarly, the diagonal slot edge 436 adjoins the slot edge 428 and also the slicing slot edge 432, defining the upper terminus of the edge 432.

Figure 31:
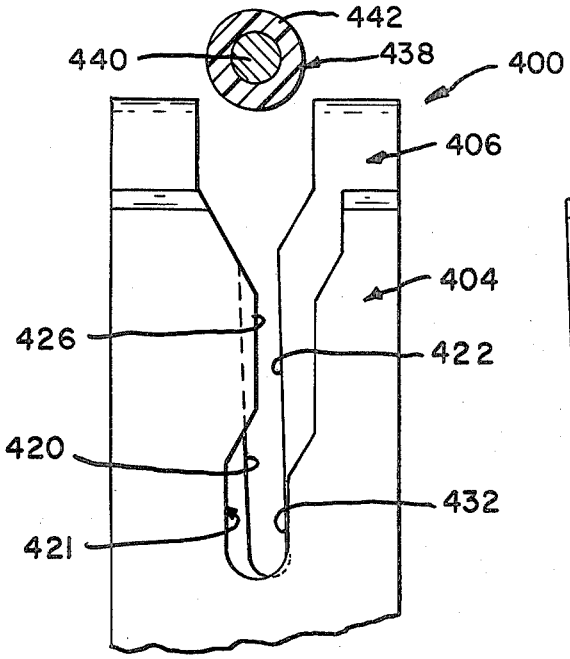
FIG. 31 is an enlarged elevation of a modification of the embodiment as shown in FIG. 29.

FIGS. 31–35 illustrate the electrical connection of one or, alternatively, a pair of wires in the terminal 400. It is further noted that the figures also illustrate a slight modification of the terminal 400. Such a modification is illustrated in FIG. 31 and occurs in the lower stage of the slot 424. FIG. 31 thus illustrates the wire slicing edge 432 in coincident alignment with at least a portion of the corresponding slicing edge 432. The edge 426 will yet project beyond the edge 420, similarly as shown in FIG. 29.

Figure 32:
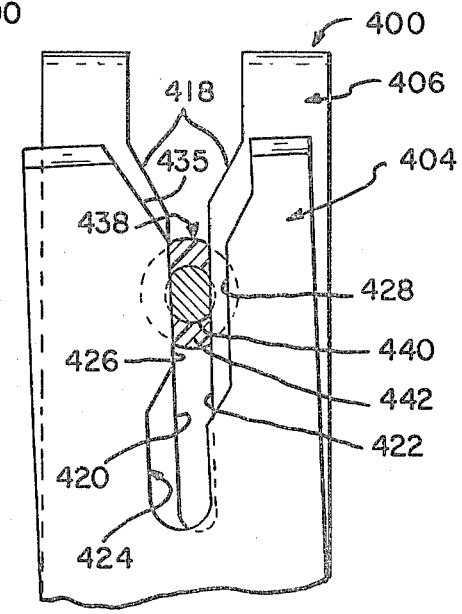
FIGS. 32 and 33 are enlarged elevations illustrating pivotal actions of the plates of the modified embodiment shown in FIG. 31, as a single wire is inserted along the slotted openings.

The terminal 400 thus may be fabricated such that the location of the slicing edge 432 varies between the two relative positions described in conjunction with FIGS. 29 and 31, without affecting the operation of the terminal. In fact, the operation is similar and will therefore be described in conjunction with the form of the terminal illustrated in FIG. 31. FIG. 31 illustrates a transverse section of an elongated insulation covered wire generally indicated at 438. The wire includes a cylindrical metal conductor 440 encircled by a sheath of insulation 442. The conductor is terminated by moving the conductor in a direction transverse to its axis into and then along the open ended slots of both plate portions 406 and 404. FIG. 32 illustrates a desired position of the wire for termination in the terminal. As the wire is inserted along the slot in plate 406 the slicing edges 420 and 432 thereof will slice through the insulation 442 and will engage the conductor 440. The width of the slot defined between the parallel slicing edges 420 and 422 is less than the diameter of the conductor. Thereby the conductor will be wedgingly retained in the slot and will become inwardly deformed or indented into generally an elongate oval configuration as the slicing edges 420 and 422 compress on opposite sides of the conductor. Additionally, as shown in FIG. 32 the wire axis passes through the upper stage of the slot 424. As the wire is traversed along the slot 424 the slicing edge 426 will slice through the insulation 442 and will engage against and inwardly deform or indent the conductor 440. The conductor 440 will be biased against the slicing edge 426 by the presence of the slot edge 422. Conversely, the conductor 440 is biased against the slicing edge 422 by the slicing edge 426. The plate portions 404 and 406 thereby are biased for movement transversely of each other as shown in FIG. 32 until the slicing edge 426 is approximately in coincident alignment with the slicing edge 420. Such movement is permitted because the plate portions are connected to each other solely by the bight portion 402, and the metal strip of which the terminal is fabricated has resilient spring properties which allow resilient deflection of the plates about their common bight 402.

Yet with reference to FIG. 32 the slot edge 428 of the slot 424 will slice through the insulation 442 but will not be compressibly engaged against the conductor 440, even though being moved toward the conductor upon the relative movement of the plates as described. The Figure shows a transverse section generally of the conductor deformed inwardly on one side by the slot edge 426, and on the other side by a slot edge 422. The distance, or width, between these edges is less than the nondeformed diameter of the conductor. Accordingly, electrical connection of the conductor 440 is established between the slicing edges 420 and 422 in the plate portion 406 and also, more importantly, between the slicing edges 426 of the plate 404 and the slicing edge 422 of the plate 406.

For example, the terminal 400 may be dimensioned to terminate either a 24 gauge or a 26 gauge wire. The 24 gause wire has a conductor of 0.0201 inches diameter or 20.1 mils. A 26 gauge wire has a conductor diameter of 15.9 mils. The width of the slot in the plate portion 406 measured between the slicing edges 420 and 422 has a width of 13 mils. The slot 424 has a width, constant along the length thereof, of 20 mils.

Figure 33:
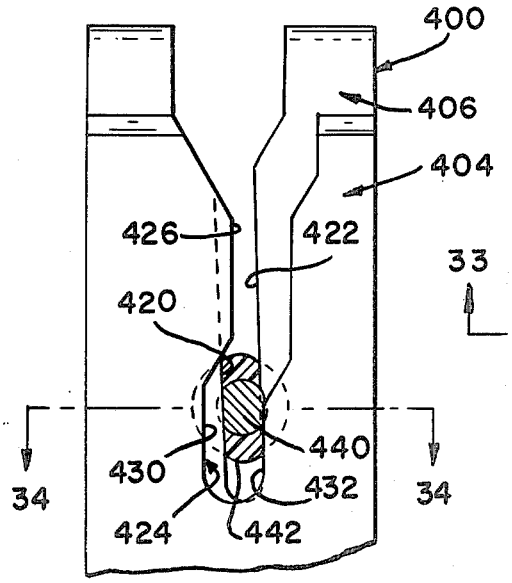
Figure 34:
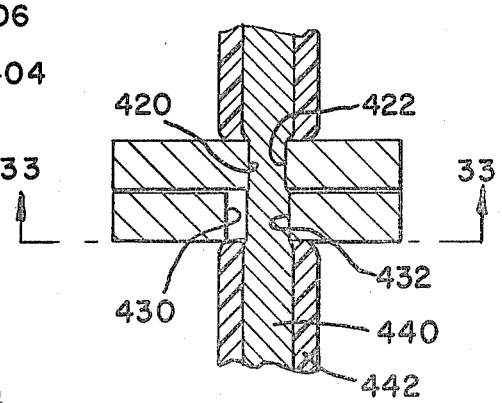
FIG. 34 is a section taken along the line 35—35 of FIG. 33.

As shown in FIG. 33, the wire 438 will be terminated successfully to the terminal 400 if traversed further along the slots of the plate portions 404 and 406. As the wire passes out of the upper stage of the slot 424 and along the slots beyond the lower terminus of the slicing edge 426, the resilient metal spring properties of the terminal will allow a substantial amount of return movement of the plate portions 404 and 406 back to their initial relative positions as shown by comparison of FIG. 31 with FIG. 33. The latter figure illustrates the conductor portion 440 of the wire entering into the lower stage of slot 424. Although the conductor is no longer terminated in the upper stage of slot 424 it remains electrically connected within the slot edges 420 and 422 of the slot in the plate portion 406. Additionally, the slot edge 420 biases the conductor toward and against the slicing edge 432 of the lower stage of the slot 424. FIG. 33 shows a transverse section of the conductor 440 deformed on the left hand side by the slot edge 420. On the opposite side, the conductor is illustrated as having an undeformed or nonindented portion being biased against the slicing edge 432. As shown in FIG. 34, taken in conjunction with FIG. 33, since at least a portion of the slot edge 432 is in coincidental alignment with the slot edge 422, and since the conductor 440 already engages the slicing edge 422 and is inwardly indented or deformed thereby, the undeformed portion of the conductor will be engaged and inwardly deformed by the slicing edge 432. Since the edge 432 also is a slicing edge it will slice through the insulation 442 for engagement on the conductor.

Figure 35:
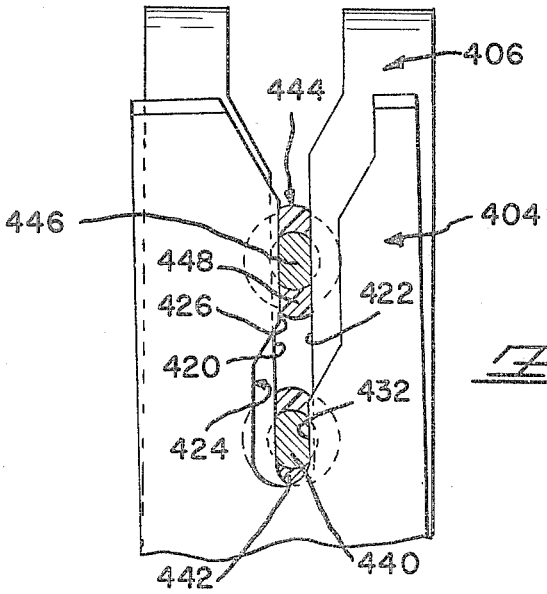
FIG. 35 is an enlarged elevation of the modified embodiment as shown in FIG. 33 with another wire inserted into the slotted openings.

The wire 440 when passing through the lower stage of the slot 424, as shown in FIG. 35, will be engaged electrically on the left hand side by the slot edge 420 and on the right hand side by both slot edges 422 and 432. The wire will also impinge against and be stopped against the tab 416 which serves as a wire stop.

FIG. 35 illustrates another wire 444 either of 24 or 26 gauge terminated in the upper stage of the slot 424 and also through the slot in the plate 406. A wire of either gauge may be terminated in the upper stage whether a 26 gauge or a 24 gauge wire is terminated in the lower stage. The slicing edges 420 and 422 will slice through the insulation 448 of the conductor to engage and compressibly deform opposite sides of the conductor 446 of the wire 444 to establish electrical connection therewith. In addition, the slicing edge 422 will tend to bias the conductor 446 against the slicing edge 426 of the upper stage of slot 424. The edge 426 also will slice through the conductor and compressibly engage and inwardly deform the corresponding side of the conductor 446 to establish electrical connection therewith. The presence of the conductor 446 will tend to bias the plates 404 and 406 for movement transversely with respect to each other as described in conjunction with FIG. 32. Such movement is restricted, however, by the presence of the conductor 440 in the lower stage of the slot 424. More particularly, in the upper stage, the slicing edge 426 tends to be biased into coincident alignment with the slot edge 420. In the lower stage, the slicing edge 432 tends to be biased into the conductor 440 to further inwardly deform or indent the conductor 440. Accordingly, the presence of the conductor 446 in the upper stage tends to narrow the width of the common slot defined between the slicing edges 420 and 422. The forces of the slot edges against the conductor 440 are thereby increased by the presence of the conductor 446. In addition, the conductor 440 resists further indentation or deformation and thereby limits the amount of movement of the two plates 404 and 406 relative to each other. As a result, the width of the common slot defined between the slicing edges 426 and 422 is narrower than the width of the common slot when only one wire is present as shown in FIG. 32. Thus the presence of a conductor in either one of the upper or lower slot stages tends to widen the width of the common slot in that stage, while tending to narrow the width of the common slot in the remaining stage, increasing further the compression on a corresponding conductor, which improves the mechanical and electrical connection therewith.

It is to be understood that the forms of the invention shown and described herein are but preferred embodiments thereof and that various changes can be made in slot design, including different widths and shapes, different stages of slots, different amounts of offset and different numbers and lengths of stages of slots, and other modifications, without departing from the spirit or scope of the invention.

We claim:

1. A double plate electrical terminal having wire-receiving slots cooperating to form a wire-receiving opening passing through both plates, the opening being divided lengthwise into sections, each wedgingly receiving therein and thereby electrically connecting therein a separate electrical wire, the presence of a wire in any one of said sections causing increased wedging pressure of each remaining section on a corresponding wedgingly received wire, the combination comprising:

a strip of metal folded back on itself along a bight to provide a pair of closely adjacent plates integrally joined to each other by said bight, each said plate having an elongated slot defined between elongated first and second slot edges, the slots of both plates cooperating to form a common wire-receiving opening passing through both plates, said first slot edges of both plates projecting along opposite sides of said opening and being adapted for wedgingly engaging therebetween a first wire projecting through said wire-receiving opening at a first section thereof, said second slot edges of both plates being disposed on opposite sides of said opening and adapted for wedgingly engaging therebetween a second wire projecting through said wire-receiving opening at a second section thereof which is in succession with and in communication with said first section, said second slot edges at said second section projecting further into said wire-receiving opening than said first slot edges, the presence of a wire wedgingly in either of said sections tending to bias apart the corresponding projecting slot edges and thereby cause both plates to flex pivotally about said common bight in opposite directions laterally of each other, thereby tending to close pivotally together the projecting slot edges of the remainder of said sections on a corresponding wedgingly received wire.

2. The structure as recited in claim 1, wherein, a slot in at least one of said adjacent plates defines a wire traversing passageway separating said projecting first slot edges of one said opening section from said projecting second slot edges of a successive opening section, whereby a wire traversing said passageway is first disengaged from wedged engagement with said first slot edges prior to being inserted in said successive opening section wedgingly between said projecting second slot edges.

3. An electrical terminal, comprising;

a pair of plates integrally connected by a common bight, each plate having a single slot through the thickness thereof defined between first and second slot edges, said plates being disposed closely adjacent each other with their slots cooperating to form a common wire-receiving opening passing through both plates, said wire-receiving opening being bounded on one side by said first slot edge of one plate and said second slot edge of the other plate, and on the other side by said second slot edge of said one plate and said first slot edge of said other plate, said opening further being divided into successively arranged first sections and at least one second section alternating successively with said first sections, each section being adapted to wedgingly engage a separate corresponding wire passing through said opening, said first alternating sections of said opening each having a width narrowed by said first slot edges projecting further into said opening than said second slot edges, thereby to wedgingly engage therebetween a corresponding wire and be wedgingly biased apart thereby without also deflecting apart said second slot edges, each said second alternating section of said opening having a width narrowed by said second slot edges projecting further into said opening than said first slot edges, thereby to wedgingly engage therebetween a corresponding wire and be wedgingly biased apart thereby without also deflecting apart said first slot edges, whereby the presence of a wire in any one of said sections which tends to bias apart corresponding slot edges also tends to pivotally flex both said plates about said bight in mutually opposite directions laterally of each other for closure pivotally toward each other of said slot edges of each remaining section in increased wedged engagement on each of the remainder of said wires.

4. The structure as recited in claim 3, wherein, a slot in at least one of said adjacent plates defines a wire traversing passageway separating said projecting first slot edges of one said opening section from said projecting second slot edges of a successive opening section, whereby a wire traversing said passageway is first disengaged from wedged engagement with said first slot edges prior to being inserted in said successive opening section wedgingly between said projecting second slot edges.

5. An electrical terminal comprising:

a pair of plates connected together by a common bight, each plate having a single slot through the thickness thereof defined between first and second slot edges, said plates being disposed closely adjacent each other with their slots cooperating to form a common wire-receiving opening passing through both plates, said opening being divided into successively arranged first and second sections, each section being adapted to wedgingly engage a separate corresponding wire passing through said opening, said first section of said opening having a width defined by and between said first slot edges of both plates on opposite sides of said opening and adapted to wedgingly engage therebetween a corresponding wire and be deflected apart thereby, said second section of said opening having a width narrowed by said second slot edges of both plates projecting further into said opening than said first slot edges, thereby to wedgingly engage therebetween a corresponding wire and be deflected apart thereby without also deflecting apart said first slot edges, whereby the presence of a wire in any one of said sections which tends to deflect apart corresponding slot edges also tends to pivotally flex both said plates about said bight in mutually opposite directions laterally of each other, and effect pivotal closure toward each other of said slot edges of the other remaining section in increased wedged engagement on the other of said wires.

6. The structure as recited in claim 5, wherein, a slot in at least one of said adjacent plates defines a wire traversing passageway separating said projecting first slot edges of one said opening section from said projecting second slot edges of a successive opening section, whereby a wire traversing said passageway is first disengaged from wedged engagement with said first slot edges prior to being inserted in said successive opening section wedgingly between said projecting second slot edges.

7. A terminal of the type in which a conductor is terminated by moving the conductor in a direction transverse to its axis into a slotted opening having a width less than the diameter of the conductor comprising:

first and second plates in a closely spaced face to face relationship, said first plate having an open ended slot therein, said second plate having an open ended slot therein, said first and second slots overlying each other and co-extending for at least a portion of their lengths along a common axis from corresponding outer edges of said plates, resilient means connecting said plates so that they may be biased relative to each other in a direction generally transverse to said common axis, said first slot having axially spaced first and second stages cooperating with said second slot to form first and second common wire receiving openings, in said first stage said first plate projects beyond the corresponding edge of said second slot so that said first common wire receiving opening has a width less than the width of said second slot and less than the diameter of the conductor to be terminated therein, in said second stage said first plate having edge means which projects beyond a corresponding edge of said second slot when said first plate is biased so as to increase the width of said first common wire receiving opening, so that when said first plate is in said biased condition said second common wire receiving opening has a width less than the width of said second slot, and less than the diamter of the conductor to be terminated therein.

8. A terminal of the type in which a conductor is terminated by moving the conductor in a direction transverse to its axis into a slotted opening having a width less than the diameter of the conductor comprising:

first and second plates in a closely spaced face to face relationship, said first plate having an open ended slot therein, said second plate having an open ended slot therein, said first and second slots overlying each other and co-extending for at least a portion of their lengths along a common axis from corresponding outer edges of said plates, said first slot having axially spaced first and second stages cooperating with said second slot to form first and second common wire receiving openings, in said first stage said first plate projects beyond the corresponding edge of said second slot so that said first common wire receiving opening has a width less than the width of said second slot and less than the diameter of the conductor to be terminated therein, in said second stage said first plate includes a wire slicing edge opposite the said corresponding edge of said second slot, said plates cooperating to define a second common wire receiving opening defined between said slicing edge and said corresponding edge of said second slot and having a width less than the width of said first slot and less than the width of a wire to be connected therein, and means pivotally connecting said plates so that increasing the width of one said common wire receiving opening will decrease the width of the other.

9. An electrical terminal comprising:

a pair of plates connected together by a common bight, each plate having a single slot through the thickness thereof defined between first and second slot edges, said plates being disposed closely adjacent with their slots cooperating with each other to define an elongated wire-receiving opening passing through both plates, a first section of said opening having a width defined between corresponding first slot edges of both said plates which are adapted for wedgingly engaging therebetween a first wire projecting through said wire-receiving opening, a second section of said opening having a width defined between corresponding second slot edges of both said plates which are adapted for wedgingly engaging therebetween a second wire projecting through said wire-receiving opening, the presence of a wire in each corresponding section of said opening tending to wedge apart corresponding slot edges and thereby cause simultaneous flexure of both said plates pivotally about said bight in mutually opposite directions laterally of each other, thereby pivotally closing together the corresponding slot edges of the other of said sections in increased wedged engagement on a corresponding wire, a slot in at least one of said adjacent plates defines a wire traversing passageway separating said projecting first slot edges of one said opening section from said projecting second slot edges of a successive opening section, whereby a wire traversing said passageway is first disengaged from wedged engagement with said first slot edges prior to being inserted in said successive opening section wedgingly between said projecting second slot edges.

* * * * *